US005549208A

United States Patent [19]

Yurga

[11] Patent Number: 5,549,208

[45] Date of Patent: Aug. 27, 1996

[54] ADJUSTABLE TARGET HOLDER

[76] Inventor: Donald C. Yurga, R.D. #1 Box 40-Y, Avonmore, Pa. 15618

[21] Appl. No.: 390,217

[22] Filed: Feb. 16, 1995

[51] Int. Cl.[6] ..... A47F 5/00

[52] U.S. Cl. ..... 211/207

[58] Field of Search ..... 211/207, 206, 211/189, 13, 190, 87, 191, 124

[56] References Cited

U.S. PATENT DOCUMENTS

| | | | |
|---|---|---|---|
| 952,603 | 3/1910 | Carroll | 211/87 |
| 3,198,343 | 8/1965 | Pollock | 211/87 |
| 3,483,996 | 12/1969 | Scammon | 211/207 X |

*Primary Examiner*—Alvin C. Chin-Shue
*Assistant Examiner*—Sarah L. Purol

[57] ABSTRACT

An adjustable target holder comprised of a pair of vertical extents. Each of the vertical extents has three coupling braces theresecured at intermediate points thereof. Three horizontal extents are securable between the coupling braces of the pair of vertical extents. A pair of spring biased upper clips are slidably secured to an uppermost horizontal extent. The pair of spring biased upper clips have a securement portion extending downwardly therefrom. The upper clips serve to hold an upper portion of a target. A pair of spring biased lower clips are slidably secured to a lowermost horizontal extent. The pair of spring biased lower clips have a securement portion extending upwardly therefrom. The lower clips serve to hold a lower portion of a target extending downwardly from the pair of spring biased upper clips.

5 Claims, 3 Drawing Sheets

ADJUSTABLE TARGET HOLDER

BACKGROUND OF THE INVENTION

1. Field of the Invention

The present invention relates to an adjustable target holder and more particularly pertains to holding different sized targets at a variety of heights with an adjustable target holder.

2. Description of the Prior Art

The use of target supports is known in the prior art. More specifically, target supports heretofore devised and utilized for the purpose of holding targets are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,176,386 to Simmons discloses an adjustable dynamic target system for firearms.

U.S. Pat. No. 4,330,129 to Meredith discloses a light duty target support apparatus.

U.S. Pat. No. 4,119,317 to Ohlund et al. discloses a target raising device with curved supporting runners.

U.S. Pat. No. Des. 329,680 to Burn discloses the ornamental design for a firearm target backstop.

U.S. Pat. No. Des. 335,311 to Robinson discloses the ornamental design for a target support.

While these devices fulfill their respective, particular objective and requirements, the aforementioned patents do not describe an adjustable target holder for holding different sized targets at a variety of heights.

In this respect, the adjustable target holder according to the present invention substantially departs from the conventional concepts and designs of the prior art, and in doing so provides an apparatus primarily developed for the purpose of holding different sized targets at a variety of heights.

Therefore, it can be appreciated that there exists a continuing need for new and improved adjustable target holder which can be used for holding different sized targets at a variety of heights. In this regard, the present invention substantially fulfills this need.

SUMMARY OF THE INVENTION

In the view of the foregoing disadvantages inherent in the known types of target supports now present in the prior art, the present invention provides an improved adjustable target holder. As such, the general purpose of the present invention, which will be described subsequently in greater detail, is to provide a new and improved adjustable target holder and method which has all the advantages of the prior art and none of the disadvantages.

To attain this, the present invention essentially comprises a pair of vertical extents. Each of the vertical extents has a first end, a second end, and an intermediate extent therebetween. The first end has a pointed portion integral therewith. The second end has an upper coupling brace theresecured by adhesive. The upper coupling brace has a support portion extending inwardly therefrom. The intermediate extent has an adjustable coupling brace secured thereto by a screw extending therethrough to the intermediate extent. The adjustable coupling brace has a support portion extending inwardly therefrom. A lower coupling brace is secured to the pair of vertical extents upwardly of each first end thereof by adhesive. The lower coupling portion has a support portion extending inwardly therefrom. The device contains three horizontal extents. A first horizontal extent is securable between the support portions of the upper coupling brace of the pair of vertical extents. A second horizontal extent is securable between the support portions of the adjustable coupling brace of the pair of vertical extents. A third horizontal extent is securable between the support portions of the lower coupling brace of the pair of vertical extents. A pair of spring biased upper clips are slidably secured to the first horizontal extent. The pair of spring biased upper clips have a securement portion extending downwardly therefrom. The upper clips serve to hold an upper portion of a target. A pair of spring biased lower clips are slidably secured to the second horizontal extent. The pair of spring biased lower clips have a securement portion extending upwardly therefrom. The lower clips serve to hold a lower portion of a target extending downwardly from the pair of spring biased upper clips.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable target holder which has all the advantages of the prior art target supports and none of the disadvantages.

It is another object of the present invention to provide a new and improved adjustable target holder which may be easily and efficiently manufactured and marketed.

It is a further object of the present invention to provide a new and improved adjustable target holder which is of durable and reliable construction.

An even further object of the present invention is to provide a new and improved adjustable target holder which is susceptible of a low cost of manufacture with regard to both materials and labor, and which accordingly is then susceptible of low prices of sale to the consuming public, thereby making such an adjustable target holder economically available to the buying public.

Still yet another object of the present invention is to provide a new and improved adjustable target holder which provides in the apparatuses and methods of the prior art some of the advantages thereof, while simultaneously overcoming some of the disadvantages normally associated therewith.

Even still another object of the present invention is to provide a new and improved adjustable target holder for holding different sized targets at a variety of heights.

Lastly, it is an object of the present invention to provide a new and improved adjustable target holder comprised of a pair of vertical extents. Each of the vertical extents has three coupling braces theresecured at intermediate points thereof. Three horizontal extents are securable between the coupling braces of the pair of vertical extents. A pair of spring biased upper clips are slidably secured to an uppermost horizontal extent. The pair of spring biased upper clips have a securement portion extending downwardly therefrom. The upper clips serve to hold an upper portion of a target. A pair of spring biased lower clips are slidably secured to a lowermost horizontal extent. The pair of spring biased lower clips have a securement portion extending upwardly therefrom. The lower clips serve to hold a lower portion of a target extending downwardly from the pair of spring biased upper clips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
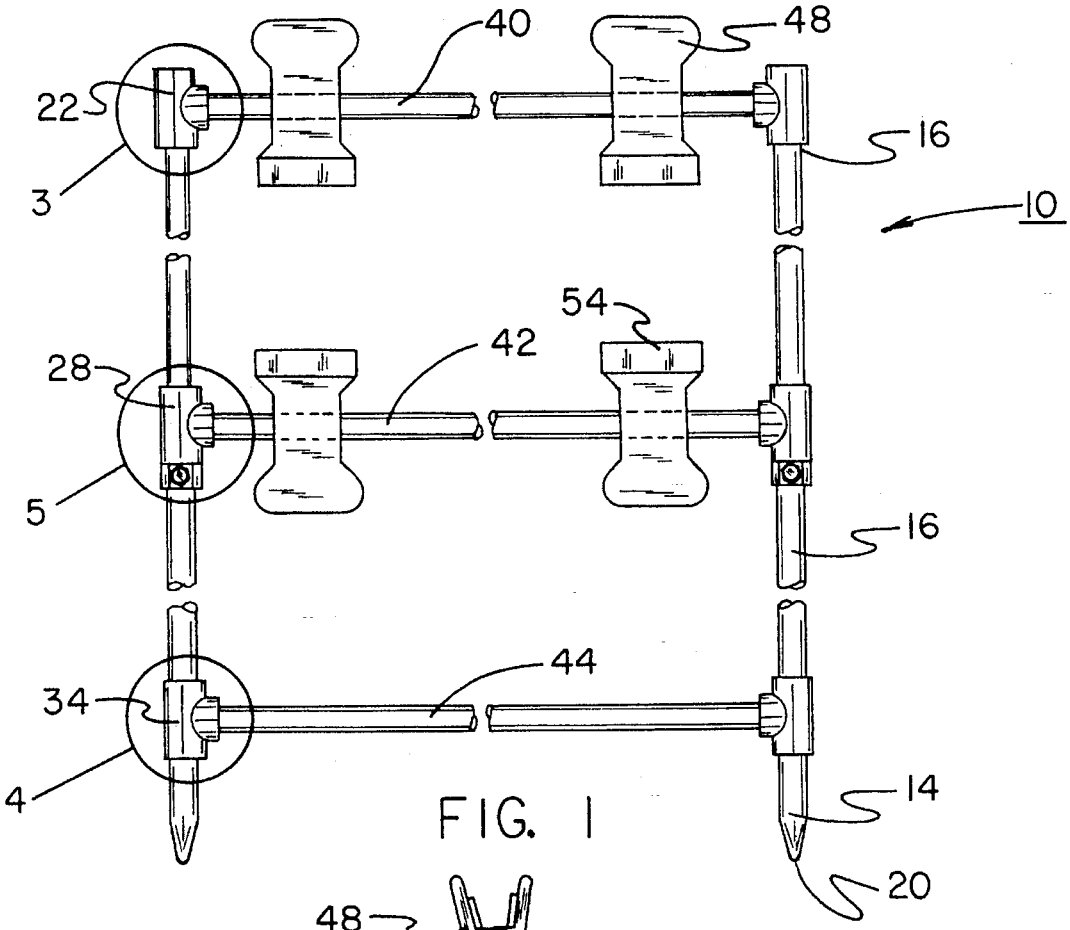
FIG. 1 is a front elevation view of the preferred embodiment of the adjustable target holder constructed in accordance with the principles of the present invention.
Figure 2:
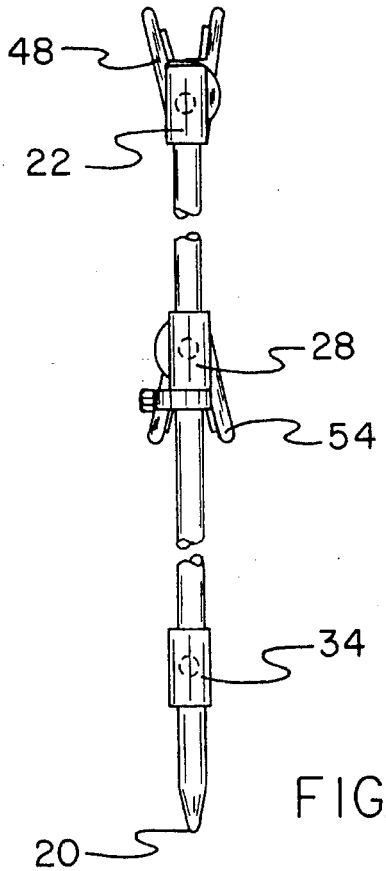
FIG. 2 is a side elevation view of the present invention.
Figure 5:
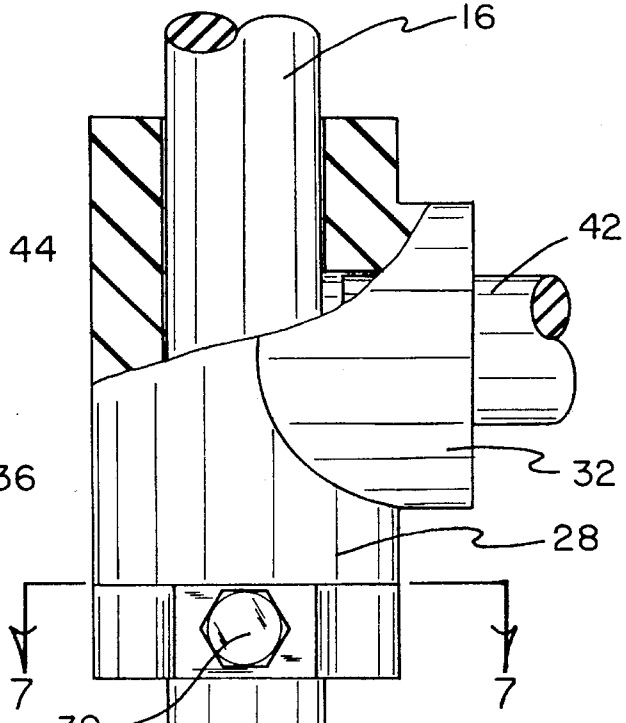
FIG. 5 is a fragmentary view of the adjustable coupling brace of the present invention.
Figure 4:
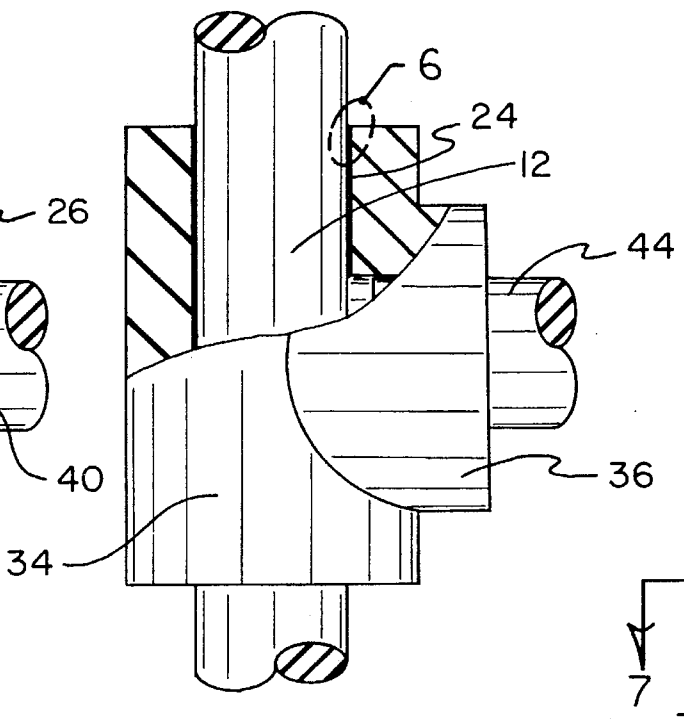
FIG. 4 is a fragmentary view of the coupling brace of the present invention.
Figure 3:
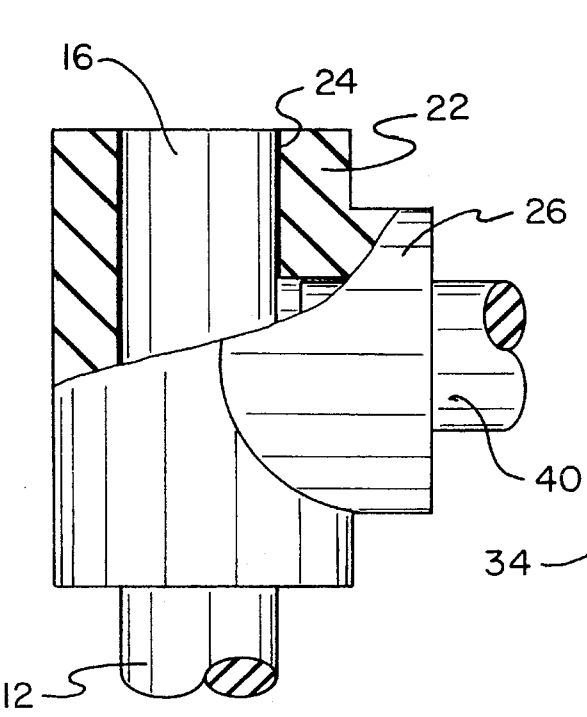
FIG. 3 is a fragmentary view of the coupling brace of the present invention.
Figure 9:
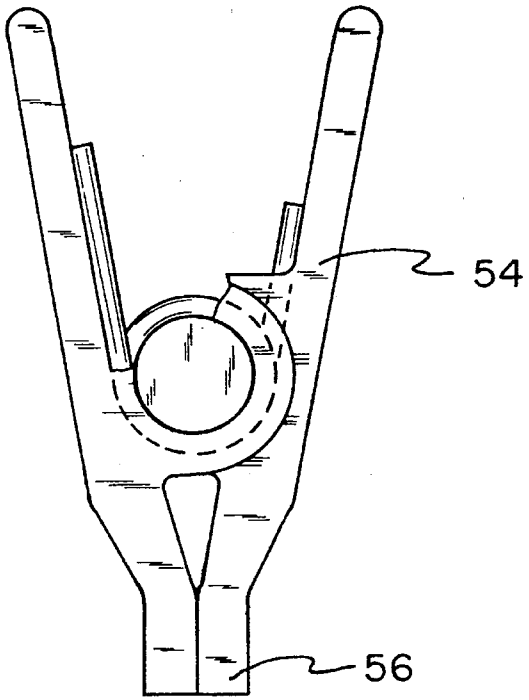
FIG. 9 is a side view of the securement clip of the present invention.
Figure 8:
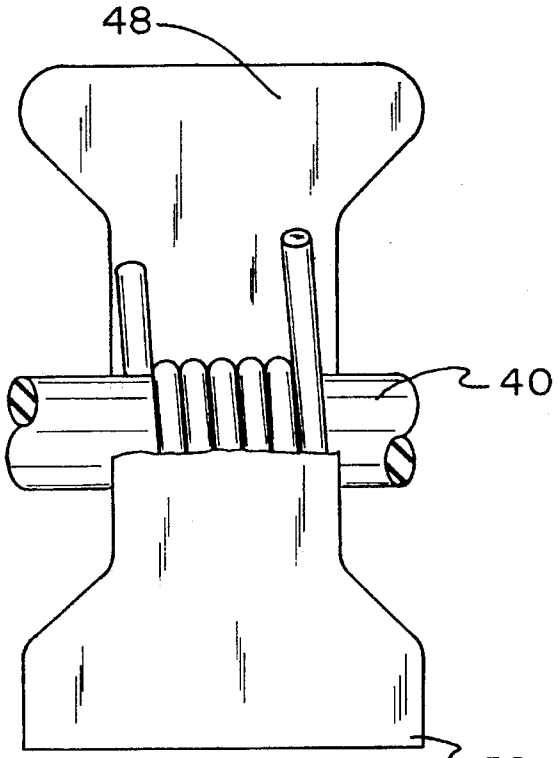
FIG. 8 is a rear view of the securement clip of the present invention.
Figure 6:
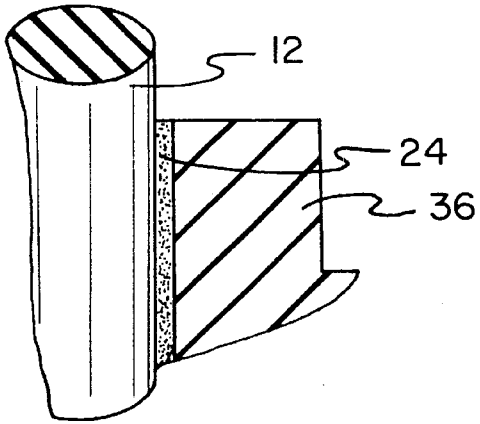
FIG. 6 is a fragmentary view of the adhesive of the coupling brace.
Figure 7:
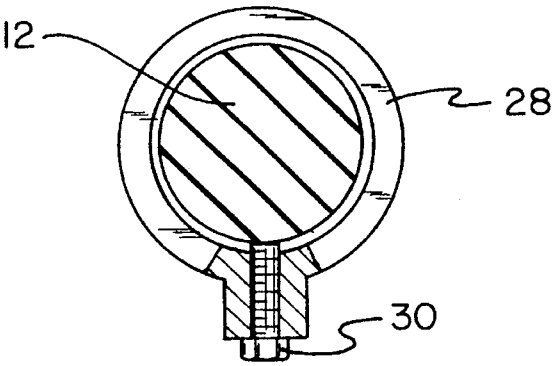
FIG. 7 is a cross-sectional view as taken along line 7—7 of FIG. 5.

With reference now to the drawings, and in particular, to FIGS. 1–9 thereof, the preferred embodiment of the new and improved adjustable target holder embodying the principles and concepts of the present invention and generally designated by the reference number 10 will be described.

Specifically, it will be noted in the various Figures that the device relates to a new and improved adjustable target holder for holding different sized targets at a variety of heights. In its broadest context, the device consists of a pair of vertical extents, three horizontal extents, a pair of spring biased upper clips, and a pair of spring biased lower clips.

The device 10 contains a pair of vertical extents 12. Each of the vertical extents 12 has a first end 14, a second end 16, and an intermediate extent 18 therebetween. The first end 14 has a pointed portion 20 integral therewith. The pointed portion 20 allows for a user to penetrate the device 10 into a ground area for supporting the pair of vertical extents 12 in an erect manner. The second end 16 has an upper coupling brace 22 theresecured by adhesive 24. The upper coupling brace 22 has a support portion 26 extending inwardly therefrom. The intermediate extent 18 has an adjustable coupling brace 28 secured thereto by a screw 30 extending therethrough to the intermediate extent 18. The adjustable coupling brace 28 has a support portion 32 extending inwardly therefrom. A lower coupling brace 34 is secured to the pair of vertical extents 12 upwardly of each first end 14 thereof by adhesive 24. The lower coupling brace 34 has a support portion 36 extending inwardly therefrom. The upper coupling brace 22 and the lower coupling brace 34 prevent the adjustable coupling brace 28 from separating from the pair of vertical extents 12.

The device 10 contains three horizontal extents. A first horizontal extent 40 is securable between the support portions 26 of the upper coupling brace 22 of the pair of vertical extents 12. A second horizontal extent 42 is securable between the support portions 32 of the adjustable coupling brace 28 of the pair of vertical extents 12. By loosening each screw 30 of the adjustable coupling brace 28, the second horizontal extent can be raised or lowered depending on the desired height of the user. A third horizontal extent 44 is securable between the support portions 36 of the lower coupling brace 34 of the pair of vertical extents 12.

A pair of spring biased upper clips 48 are slidably secured to the first horizontal extent 40. The upper clips 48 can slide along the first horizontal extent 40 to accommodate different sized targets. The pair of spring biased upper clips 48 have a securement portion 50 extending downwardly therefrom. The upper clips 48 serve to hold an upper portion of a target.

A pair of spring biased lower clips 54 are slidably secured to the second horizontal extent 42. The pair of spring biased lower clips 54 have a securement portion 56 extending upwardly therefrom. The lower clips 54 serve to hold a lower portion of a target extending downwardly from the pair of spring biased upper clips 48. Another option has the second horizontal extent 42 having an additional pair of spring biased lower clips slidably secured thereto. The additional pair of spring biased lower clips have a securement portion extending downwardly therefrom. The additional lower clips serve to hold an upper portion of a target. In addition, the third horizontal extent 44 has a pair of spring biased clips slidably secured thereto. The pair of spring biased clips have a securement portion extending upwardly therefrom. The lower clips serve to hold a lower portion of a target extending downwardly from the additional pair of spring biased lower clips. This option would allow for a greater amount of targets to be held by the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable target holder for holding different sized targets at a variety of heights comprising, in combination:

a pair of vertical extents, each of the vertical extents having a first end, a second end, and an intermediate extent therebetween, the first end having a pointed portion being integral therewith, the second end having an upper coupling brace theresecured by adhesive, the upper coupling brace having a support portion extending inwardly therefrom, the intermediate extent having an adjustable coupling brace secured thereto by a screw extending therethrough to the intermediate extent, the adjustable coupling brace having a support portion extending inwardly therefrom, a lower coupling brace secured to the pair of vertical extents upwardly of each first end thereof by adhesive, the lower coupling brace having a support portion extending inwardly therefrom;

three horizontal extents, a first horizontal extent securable between the support portions of the upper coupling brace of the pair of vertical extents, a second horizontal extent securable between the support portions of the adjustable coupling brace of the pair of vertical extents, a third horizontal extent securable between the support portions of the lower coupling brace of the pair of vertical extents;

a pair of spring biased upper clips slidably secured to the first horizontal extent, the pair of spring biased upper clips having a securement portion extending downwardly therefrom, the upper clips serving to hold an upper portion of a target;

a pair of spring biased lower clips slidably secured to the second horizontal extent, the pair of spring biased lower clips having a securement portion extending upwardly therefrom, the lower clips serving to hold a lower portion of a target extending downwardly from the pair of spring biased upper clips.

2. An adjustable target holder for holding different sized targets at a variety of heights comprising, in combination:

a pair of vertical extents, each of the vertical extents having three coupling braces theresecured at intermediate points thereof;

three horizontal extents securable between the coupling braces of the pair of vertical extents;

a pair of spring biased upper clips slidably secured to an uppermost horizontal extent, the pair of spring biased upper clips having a securement portion extending downwardly therefrom, the upper clips serving to hold an upper portion of a target;

a pair of spring biased lower clips slidably secured to a lowermost horizontal extent, the pair of spring biased lower clips having a securement portion extending upwardly therefrom, the lower clips serving to hold a lower portion of a target extending downwardly from the pair of spring biased upper clips.

3. The holder as described in claim 1 and further including wherein the second horizontal extent having an additional pair of spring biased lower clips slidably secured thereto, the additional pair of spring biased lower clips having a securement portion extending downwardly therefrom, the additional lower clips serving to hold an upper portion of a target.

4. The holder as described in claim 3 and further including wherein the third horizontal extent having a pair of spring biased clips slidably secured thereto, the pair of spring biased clips having a securement portion extending upwardly therefrom, the lower clips serving to hold a lower portion of a target extending downwardly from the additional pair of spring biased lower clips.

5. The holder as described in claim 2 and further including wherein an intermediate coupling brace of the pair of vertical extents is vertically adjustable.

* * * * *